US005286025A

United States Patent [19]

Mulyca et al.

[11] Patent Number: 5,286,025

[45] Date of Patent: Feb. 15, 1994

[54] MULTIPLE BINGO CARD HOLDER APPARATUS

[76] Inventors: Eric E. Mulyca; Edward A. Mulyca, both of 140 Rotterdam St., Schenectady, N.Y. 12306

[21] Appl. No.: 61,262

[22] Filed: May 17, 1993

[51] Int. Cl.[5] ..... A63F 3/06

[52] U.S. Cl. ..... 273/148 R; 273/148 A; 273/269; 273/240; 273/309; 40/158.1

[58] Field of Search ..... 273/148 A, 148 R, 157 A, 273/240, 269, 309; 40/157, 158.1, 159

[56] References Cited

U.S. PATENT DOCUMENTS 3,811,680 5/1974 Benesch ..... 273/240
4,630,830 12/1986 Gadd ..... 273/269
4,794,716 1/1989 George et al. ..... 40/158.1
5,096,752 3/1992 Wagner ..... 40/158.1
5,213,362 5/1993 Rundell et al. ..... 273/148 A

*Primary Examiner*—Benjamin H. Layno
*Attorney, Agent, or Firm*—Leon Gilden

[57] ABSTRACT

A base block is arranged to mount a first transparent web, wherein a top block is mounted to the base block to mount and secure a second transparent web in a coextensive relationship relative to the first transparent web to permit the positioning of a plurality of bingo cards between the webs, with bingo dauber members arranged for marking through the transparent web structure for imparting reference to the underlying bingo cards.

5 Claims, 4 Drawing Sheets

MULTIPLE BINGO CARD HOLDER APPARATUS

BACKGROUND OF THE INVENTION

1. Field of the Invention

The field of invention relates to bingo apparatus, and more particularly pertains to a new and improved multiple bingo card holder apparatus wherein the same is arranged for the positioning of multiple bingo cards during a game playing procedure.

2. Description of the Prior Art

Bingo card holders and structure of various types have been utilized throughout the prior art and exemplified by the U.S. Pat. Nos. 3,895,806; 4,798,387; 4,981,301; 3,689,072; and 4,365,810.

The instant invention attempts to overcome deficiencies of the prior art by providing for the ease of mounting and marking of a multiple of bingo cards during a game playing procedure and in this respect, the present invention substantially fulfills this need.

SUMMARY OF THE INVENTION

In view of the foregoing disadvantages inherent in the known types of bingo card holder apparatus now present in the prior art, the present invention provides a multiple bingo card holder apparatus wherein the same is directed to the storage and positioning of a multiple of bingo cards during a game playing procedure. As such, the general purpose of the present invention, which will be described subsequently in greater detail, is to provide a new and improved multiple bingo card holder apparatus which has all the advantages of the prior art bingo card holder apparatus and none of the disadvantages.

To attain this, the present invention provides a base block arranged to mount a first transparent web, wherein a top block is mounted to the base block to mount and secure a second transparent web in a coextensive relationship relative to the first transparent web to permit the positioning of a plurality of bingo cards between the webs, with bingo dauber members arranged for marking through the transparent web structure for imparting reference to the underlying bingo cards.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved multiple bingo card holder apparatus which has all the advantages of the prior art bingo card holder apparatus and none of the disadvantages.

It is another object of the present invention to provide a new and improved multiple bingo card holder apparatus which may be easily and efficiently manufactured and marketed.

It is a further object of the present invention to provide a new and improved multiple bingo card holder apparatus which is of a durable and reliable construction.

An even further object of the present invention is to provide a new and improved multiple bingo card holder apparatus which is susceptible of a low cost of manufacture with regard to both materials and labor, and which accordingly is then susceptible of low prices of sale to the consuming public, thereby making such multiple bingo card holder apparatus economically available to the buying public.

Still yet another object of the present invention is to provide a new and improved multiple bingo card holder apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
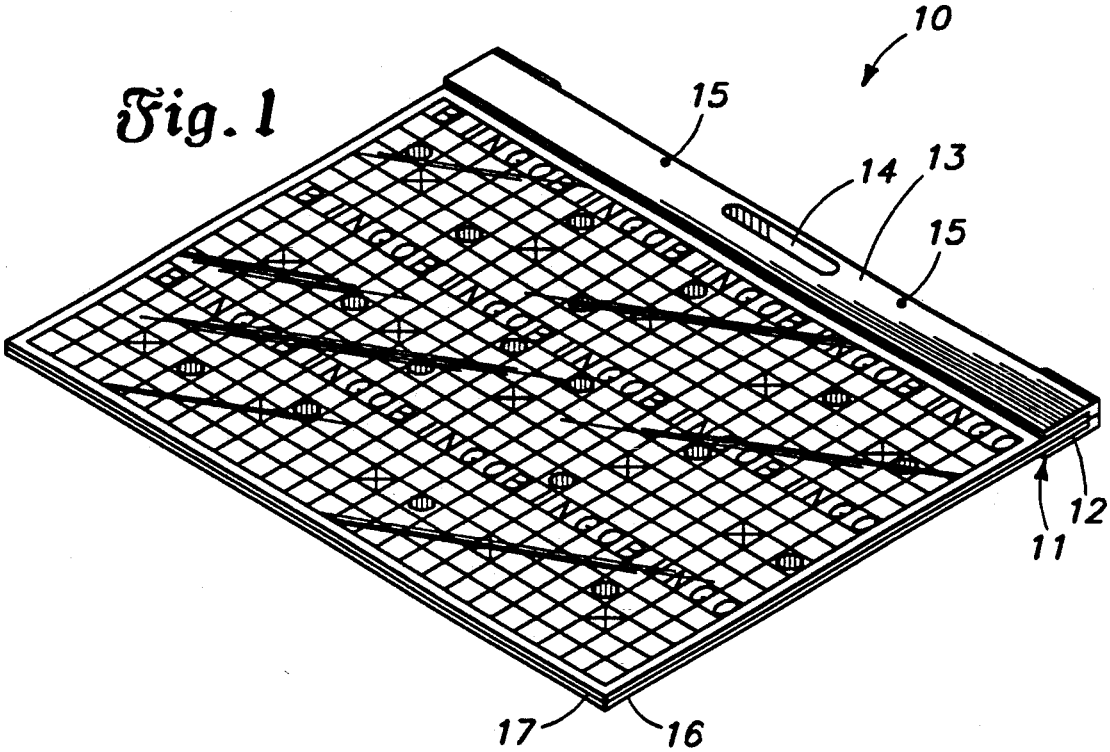
FIG. 1 is an isometric illustration of the invention.

With reference now to the drawings, and in particular to FIGS. 1 to 8 thereof, a new and improved multiple bingo card holder apparatus embodying the principles and concepts of the present invention and generally designated by the reference numeral 10 will be described.

Figure 2:
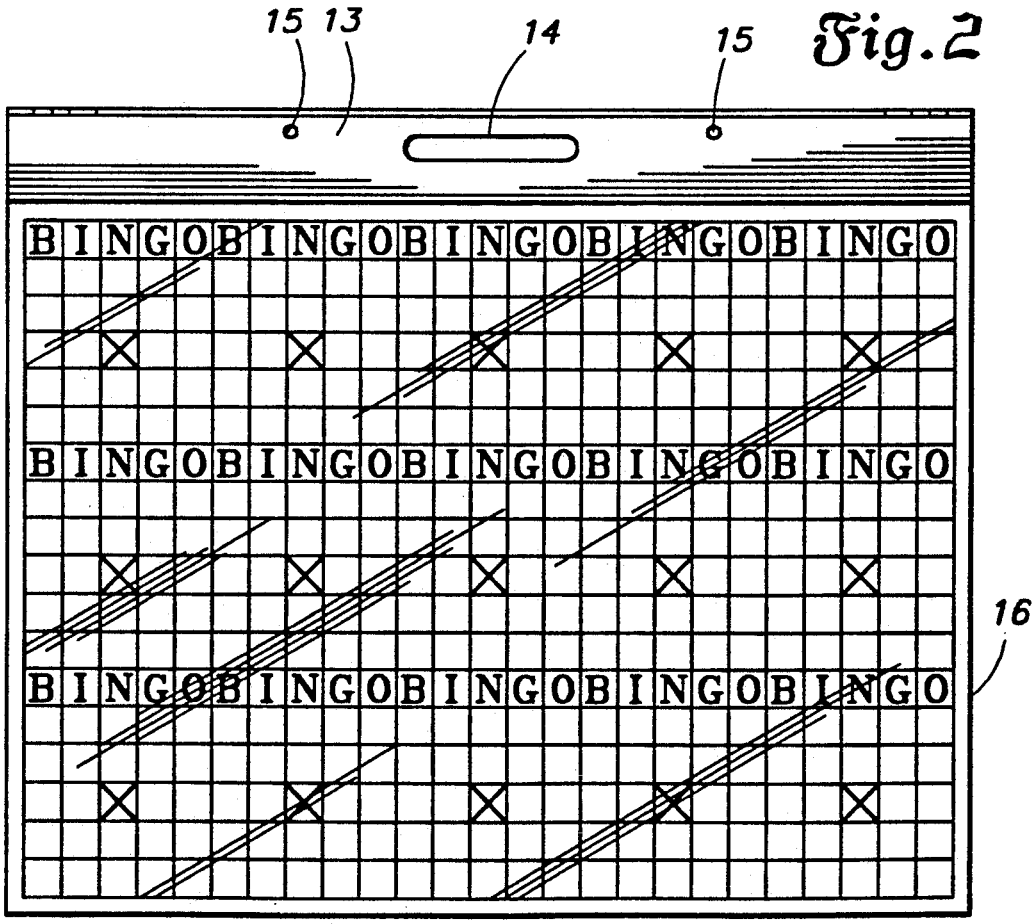
FIG. 2 is an orthographic top view of the invention.
Figure 3:
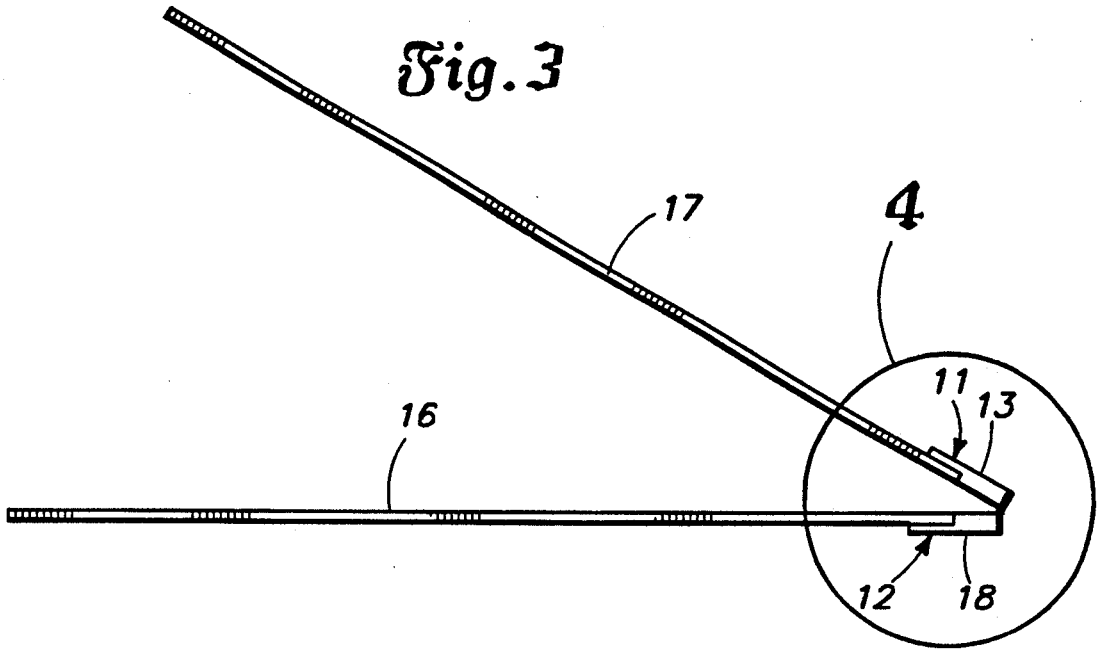
FIG. 3 is an orthographic side view of the invention in an opened configuration to accommodate a plurality of bingo cards therewithin.
Figure 4:
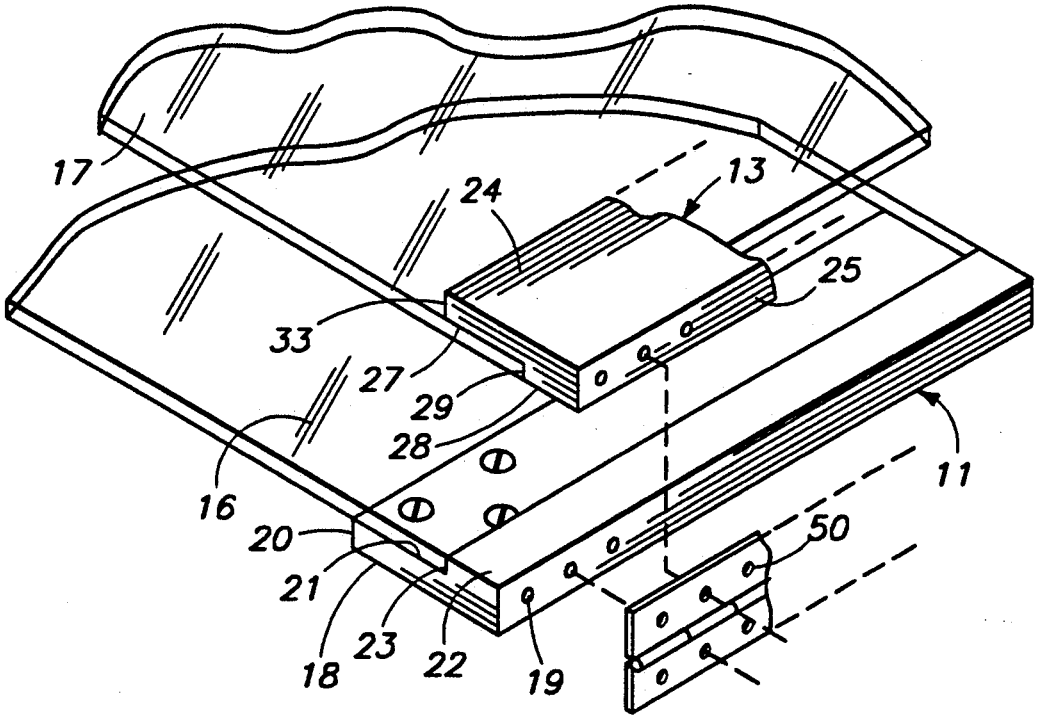
FIG. 4 is an enlarged isometric illustration, in exploded view, of a hinge construction as indicated in Section 4 of FIG. 3.

More specifically, the multiple bingo card holder apparatus 10 of the instant invention essentially comprises a hinge block assembly 11 including a base block 12, with a first rigid transparent web 16 mounted to the base block 12, with a second rigid transparent web 17 coextensively oriented relative to the first transparent web 16, with the second transparent web 17 mounted to the top block 13 to accommodate a matrix of bingo cards, in a manner as illustrated in FIGS. 1 and 2 secured between the first and second transparent webs. An elongate handle opening 14 is directed medially of and through the base block 12, the top block 13, and the first and second transparent webs 16 and 17 on a through-extending relationship permitting ease of transport of the organization. Through-extending mounting apertures 15 on opposite sides of the handle opening 14 permit support of the organization receiving any convenient rod therethrough (not shown).

The base block 12 includes a base block bottom wall 18*a*, a base block rear wall 19, a base block front wall 20, a first top wall 21 extending from the base block front wall 20 to a spaced relationship relative to the base block rear wall 19, with the first top wall 21 arranged at a first spacing relative to the base block bottom wall 18*a*. A second top wall 22 extending from the first top wall 21 extends to the base block rear wall 19 at a second spacing relative to the base block bottom wall 18*a* that is greater than the first spacing. Accordingly, a base block abutment wall 23 orthogonally directed between the first and second top walls 21 and 22 accommodates in an abutting relationship the first transparent web 13 of a generally rectilinear configuration and extending coextensively relative to the base block 12.

The top block 13 includes a top block top wall 24, a top block rear wall 25, a top hinge block front wall 33, with a top block first bottom wall 27 extending from the top hinge block front wall 33 towards the top block rear wall 25. A top hinge block second bottom wall 28 extends from the top hinge block first bottom wall 27 to the top hinge block rear wall 25, with a resultant top hinge block abutment wall 29 extending orthogonally between the first and second bottom wall 27 and 28, with the top hinge block abutment wall 29 receiving in an abutting relationship, the second transparent web 17. In this manner, the matrix of bingo cards are removably mounted between the first and second transparent webs 16 and 17, as indicated in FIGS. 1 and 2. It should be further noted that a hinge member 50 is mounted to the top hinge block rear wall 25 and to the base block rear wall 19 providing for the pivoting relationship of the hinge blocks 12 and 13.

Figure 5:
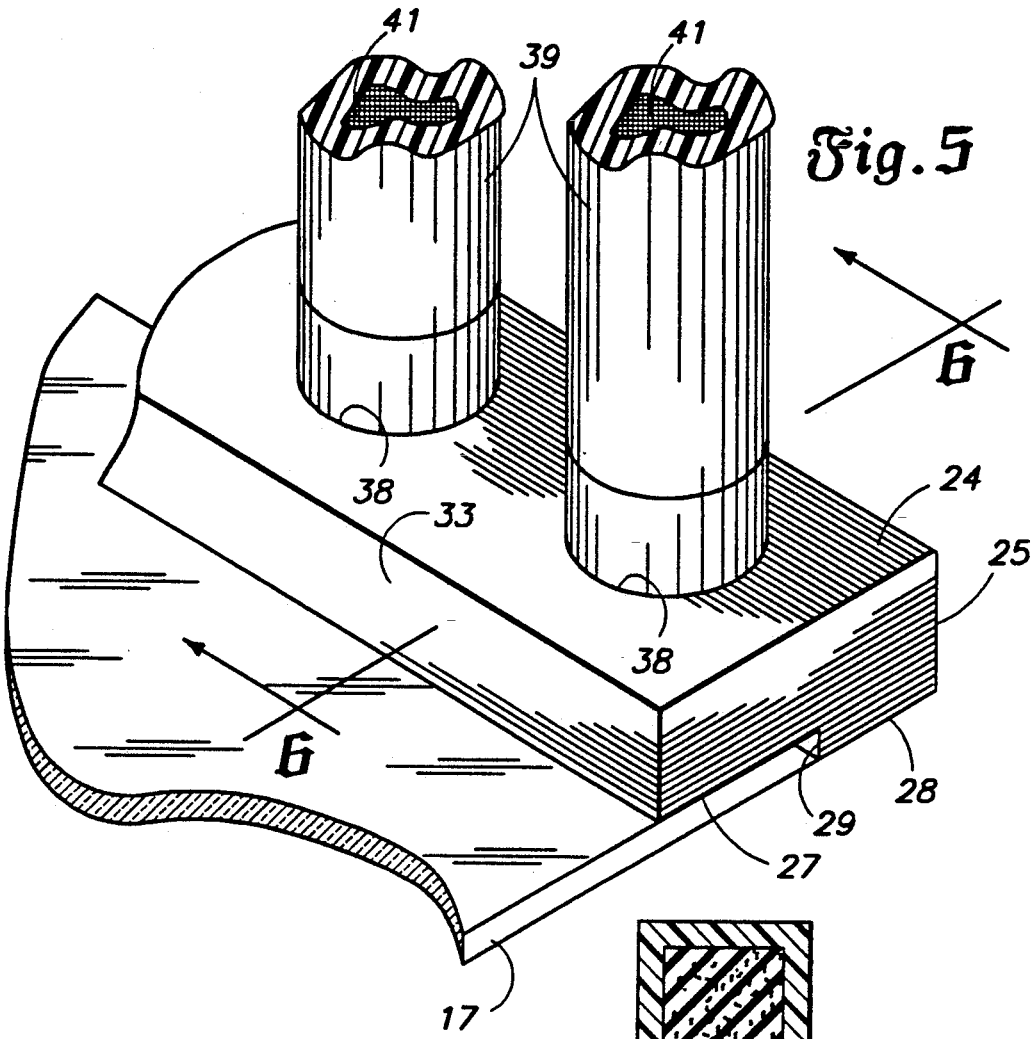
FIG. 5 is an isometric illustration of a modified top hinge block structure.
Figure 6:
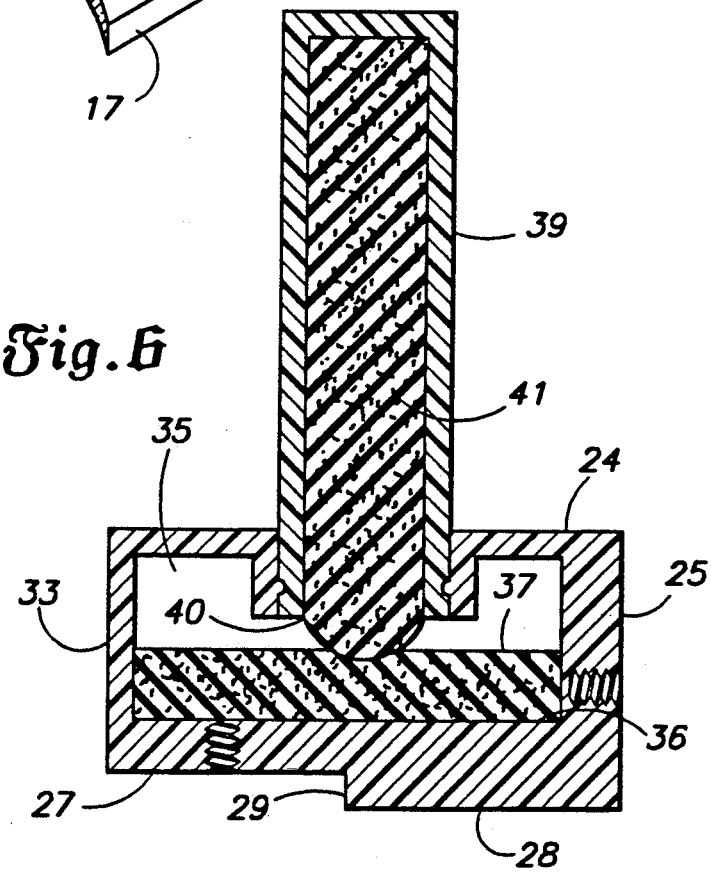
FIG. 6 is an orthographic view, taken along the lines 6—6 of FIG. 5 in the direction indicated by the arrows.
Figure 7:
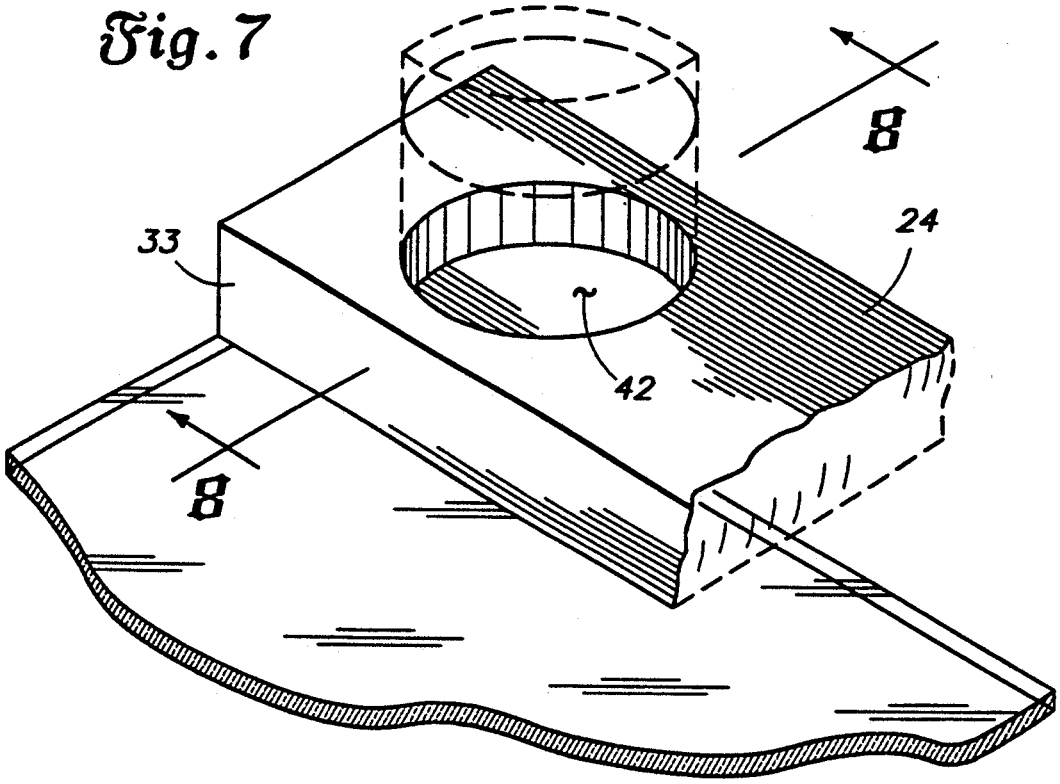
FIG. 7 is an isometric illustration of the modified top hinge block structure.
Figure 8:
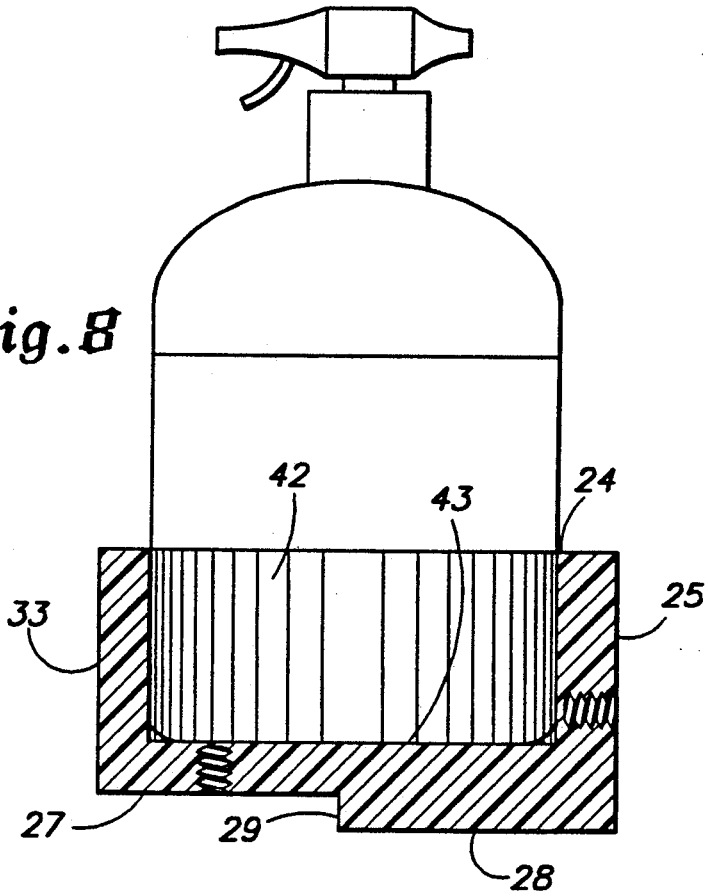
FIG. 8 is an orthographic view, taken along the lines 8—8 of FIG. 7 in the direction indicated by the arrows.

The FIG. 5 indicates the top block 13 having a hinge block cavity 35 oriented below the top hinge block top wall 24, having a cavity floor 36 containing a fluid saturated sponge member 37 containing a fluid dye. A plurality of right top wall openings 38 are directed through the top hinge block top wall to each receive a tubular marker housing 39. Each marker housing 39 includes a housing opening 40, with a housing sponge insert 41 directed coextensively through the housing 39 extending beyond the housing opening 40 for contiguous communication with the fluid sponge member 37 to direct fluid from the sponge member to the housing sponge insert 41 for marking cards imparting the sponge insert 41 onto the second transparent web 14 to mark an underlying bingo card.

Accordingly, the top hinge block top wall 24 includes second block top wall recess 42 spaced from the top wall openings 38. A recess floor 43 is provided to position a fluid container 44 therewithin. The fluid container 44 is arranged to contain commercial cleaners or solvents subsequent to utilization of the bingo cards, cleaning of the second web is effected by dispensing cleaning solution from the fluid container 44 onto the top surface of the second web 14 for subsequent and continued use of the structure in subsequent bingo game procedures.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A multiple bingo card holder apparatus, comprising, a base block, the base block including a base block bottom wall, a base block rear wall, a base block front wall, and a first top wall extending from the base block front wall, and a base block second top wall extending from the base block first top wall to the base block rear wall, and the first top wall spaced from the base block bottom wall a first spacing, the second top wall spaced from the base block bottom wall a second spacing, with the second spacing greater than the first spacing, and a base block abutment wall extending coextensively of the first top wall and the second top wall in an orthogonal relationship relative to the first top wall and the second top wall, and a first rigid transparent web coextensively mounted in communication with the base block abutment wall, and a top hinge block hingedly mounted to the base block rear wall, wherein the top hinge block includes a second rigid transparent web coextensive with the first rigid transparent web, and the second rigid transparent web fixedly mounted to the top block.

2. An apparatus as set forth in claim 1 wherein the top hinge block includes a top hinge block top wall, a top hinge block rear wall, a top hinge block front wall, a top hinge block first bottom wall, and a top hinge block second bottom wall spaced from the top hinge block first bottom wall, and a top hinge block abutment wall orthogonally oriented and coextensive of the top hinge block first bottom wall and the top hinge block second bottom wall and the second rigid transparent web arranged in abutting communication with the top hinge block abutment wall fixedly mounted to the top hinge block first bottom wall.

3. An apparatus as set forth in claim 2 wherein the first rigid transparent web is in contiguous and fixed communication to the base block first top wall.

4. An apparatus as set forth in claim 3 wherein the top hinge block top wall includes a plurality of top hinge block openings, and the top hinge block includes a right hinge block cavity positioned below the top hinge block top wall, with the top hinge block cavity having a cavity floor, and a fluid sponge member mounted to the cavity floor, with the fluid sponge member including a marking dye, and a plurality of tubular marker housings, with each tubular marker housing mounted within one of said right block top wall openings, and each tubular marker housing having a housing opening, and each housing having a housing sponge insert coextensive with the tubular marker housing and extending beyond the housing opening, with each housing sponge insert in contiguous communication with the fluid sponge member.

5. An apparatus as set forth in claim 4 wherein the top hinge block top wall includes a second block top wall recess, and the second block top wall recess including a recess floor, and a fluid dispensing container mounted within the top wall recess in communication with the recess floor.

* * * * *